United States Patent [19]

Schwob

[11] 4,414,766

[45] Nov. 15, 1983

[54] STEAM IRON SOLE PLATE DESIGN

[75] Inventor: Pierre Schwob, Lyons, France

[73] Assignee: SEB S.A., Selongey, France

[21] Appl. No.: 298,372

[22] Filed: Sep. 1, 1981

[30] Foreign Application Priority Data

Sep. 10, 1980 [FR] France ..... 80 19492

[51] Int. Cl.[3] ..... D06F 75/18

[52] U.S. Cl. ..... 38/77.83

[58] Field of Search ..... 38/77.82, 77.83, 77.7, 38/77.9, 77.8, 77.5; 219/245, 271

[56] References Cited

U.S. PATENT DOCUMENTS

| | | | |
|---|---|---|---|
| 2,547,558 | 4/1951 | Bremer | 38/77.7 |
| 3,134,182 | 5/1964 | Morton . | |
| 3,136,080 | 6/1964 | Albrecht | 38/77.7 |
| 3,188,757 | 6/1965 | Denton | 38/77.7 |
| 3,368,294 | 2/1968 | Martin | 38/77.7 |
| 3,711,972 | 1/1973 | Bisacher . | |
| 3,823,498 | 7/1974 | Davidson . | |

FOREIGN PATENT DOCUMENTS 2231799 12/1974 France .

*Primary Examiner*—Werner H. Schroeder
*Assistant Examiner*—Andrew M. Falik
*Attorney, Agent, or Firm*—Young & Thompson

[57] ABSTRACT

An electric steam iron is provided with an auxiliary water injection device to obtain an instantaneous surplus of steam. The point of auxiliary injection (6) is located directly above a boss (3) into which a resistor type heating element (2) is cast. The boss has a planar top surface which is sloped in a direction towards a main vaporization chamber (4). The thickness of the boss between the heating element and its top surface is reduced to effect a rapid vaporization of the injected water.

3 Claims, 3 Drawing Figures

STEAM IRON SOLE PLATE DESIGN

BACKGROUND OF THE INVENTION

The present invention relates to an electric steam iron of the type comprising an injection device for letting a certain amount of water flow into a vaporization chamber from which the steam which is formed escapes through openings in the sole-plate.

Steam irons of this type allow dispensing of a certain moderate amount of steam which can be regulated within certain limits to effect ironing. However, for special kinds of work a considerable surplus of steam is needed for a short time. It is known to use in this case an auxiliary injection device which brings in water in accordance with the amount of steam needed.

If this relatively large surplus of water is admitted directly into the vaporization chamber of a conventional iron, there is a risk of producing an abundance of scale and there is the risk of incomplete vaporization with the deposit of water on the pieces to be ironed and possibly the formation of scale deposits. In addition, the projection of little droplets of water can cause spots.

It has been proposed to effect an auxiliary injection in an auxiliary chamber formed by a conduit of great length and small cross section which is provided with baffles. This allows retardation of the water flow and facilitates total vaporization. The abundant vaporization however which occurs in these narrow conduits with baffles produces a rapid and unacceptable scale deposit which is very difficult to eliminate.

SUMMARY OF THE INVENTION

It is an object of the present invention to provide a steam iron with total and quasi-instantaneous vaporization and without any significant scale deposit.

According to the invention, the electric steam iron comprises a metallic sole plate having a boss and a heating element cast in said boss enclosing a vaporization chamber, a main injection device connected with a water reservoir to inject water into said vaporization chamber adjacent to said boss, and an auxiliary injection device for injecting an amount of supplementary water with the object of obtaining an instantaneous surplus of steam. Said auxiliary injection device empties into the vaporization chamber at a point situated on the boss; and the iron is characterized in that in the area around said point, the metal of the boss is of reduced thickness such that the heating element cast in said boss is close to said point in said area, said area being in communication with the vaporization chamber.

The temperature of the metal at the point of water inlet of the auxiliary injection is very high, whereby a rapid vaporization is caused.

The small quantity of residual water vaporizes easily in the vaporization chamber. There is thus no risk of depositing water on the pieces to be ironed.

According to a preferred embodiment of the invention, the thin area of the boss is substantially planar and has a slope descending toward the vaporization chamber.

In this manner, the water which is not instantaneously vaporized flows easily into the vaporization chamber to be vaporized thereat.

Preferably the planar and thin area has an enlarged portion positioned in the area of the auxiliary injection point.

This enlarged portion allows the auxiliary injection to empty always into the area in question even when the movements given to the iron by the user disturb the input of the water.

Other features and advantages of the invention will appear from the detailed description which follows.

BRIEF DESCRIPTION OF THE DRAWINGS

The drawings show the following by way of non-limitative example.

DESCRIPTION OF THE PREFERRED EMBODIMENT

Figure 1:
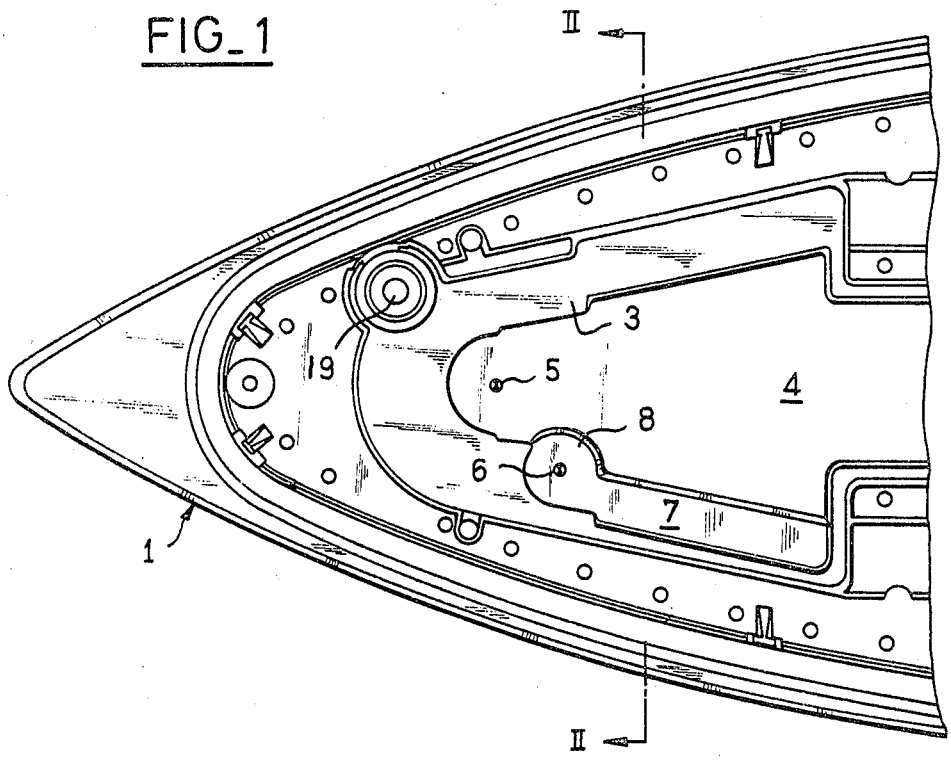
FIG. 1 is a partial view of an iron sole-plate according to the invention.

Referring now to the figures, a sole-plate 1 of a steam iron comprises a protected electric resistor 2, forming a heating element which is arranged in U-form and is cast in a boss 3 integral with the sole-plate 1.

The steam iron comprises, as is known, a main injection device 9 for water from a water reservoir 11, provided for letting water droplets fall into a vaporization chamber 4, situated between the branches of a U-shaped heating element 2. The point of water input of this main injection is positioned in the region of the base of the U, near the point 5.

The iron according to the invention further comprises, as is known, an auxiliary injection device 10 which can be actuated independently from the main device 9 to obtain an instantaneous surplus of steam.

Figure 2:
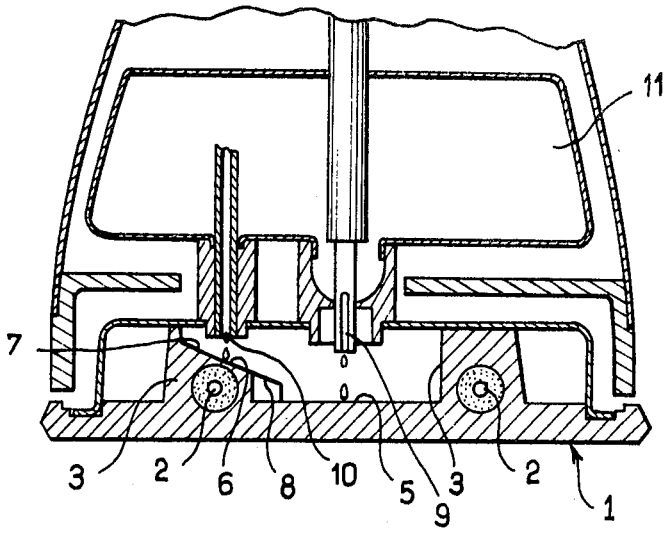
FIG. 2 is a sectional view along the line II—II in FIG. 1.

Said auxiliary injection device 10 is arranged in such a way that the injection occurs above a point 6, situated on the boss 3. In the area around this point 6, the metal constituting the boss 3 is thin such that the insulation of the resistor 2 is almost exposed at the surface of the boss 3. (FIG. 2). The thin area 7 is planar extends over a certain length of the boss 3 and has a slope descending toward the vaporization chamber 4.

Finally, the thin area 7 has around the injection point 6 an enlarged portion 8 directed toward the vaporization chamber.

In normal operation the main injection flows into the region of point 5 and partly evaporates there. The non-vaporized water flows into the chamber 4 and evaporates there. As a result of the large dimensions of this chamber the scale deposit is distributed over a large surface and is therefore very thin.

To obtain an instantaneous surplus of steam, the auxiliary injection device 10 is actuated which lets the water fall onto area 7 near point 6. Because of the thinness of the metal of the boss 3 in the area 7, the surface of the area 7 is at a very high temperature which causes a quasi-instantaneous vaporization of a large part of the water.

The non-vaporized water rebounds partly to fall back in droplets on the area 7 where it vaporizes while leaving a deposit of rather thin, spread-out scale. Due to the fact that the area 7 is inclined, the rebounding and the falling back have moreover the tendency to be carried out preferentially toward the vaporization chamber 4.

The inclination also allows the non-vaporized water which wets the area 7 to flow toward the chamber 4.

Finally, in spite of the user's movements imparted to the iron, the enlarged portion 8 causes the non vaporized water to always in flow into the interior area.

The invention makes it possible to attain a total vaporization of the auxiliary injection which is completed in the vaporization chamber 4 and is quasi-intantaneous.

Due to the bursting of the water droplets and their projection on a large surface, the scale deposit is spread out and is only very thin. A minimal scale deposit is, of course, necessary in order to avoid the phenomenon of heat build-up.

Figure 3:
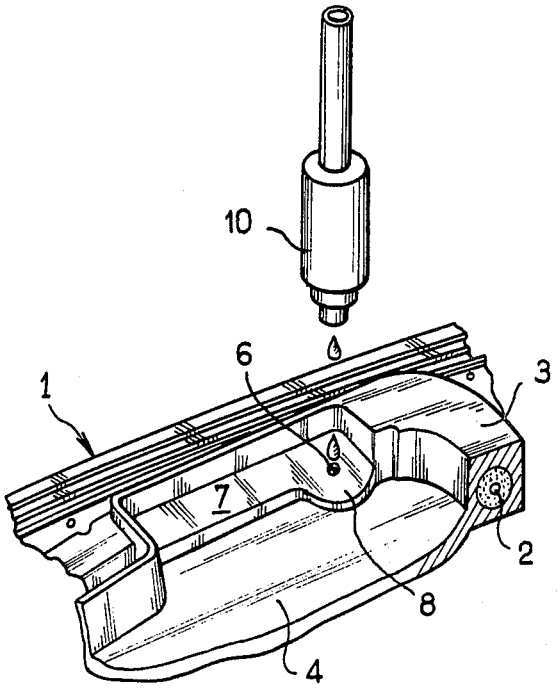
FIG. 3 is a perspective view of a portion of the sole-plate, showing the area of water input of the auxiliary injection.

In addition, an unexpected advantage of the invention has been found, i.e. that the flowing in of the auxiliary water doesn't cool down the boss 3 and affect the thermostat fixed at 19 located a certain distance from the point 6 where the water falls. It is assumed that this phenomenon is caused by the said thin cross sectional portion of the boss 3 (FIG. 3) which reduces its thermal conductance.

It is to be understood that the invention is not limited to the described example but covers all minor modifications thereof which are within the scope of one skilled in the art.

I claim:

1. An electric steam iron, comprising a metallic soleplate having a boss and a heating element, cast in said boss, said boss enclosing a vaporization chamber, a main injection device connected to a water reservoir for injecting water into said vaporization chamber adjacent to said boss, and an auxiliary injection device for injecting a supplementary amount of water for obtaining an instantaneous surplus of steam, said auxiliary injection device emptying into the vaporization chamber at a point situated on the boss just above the heating element cast in said boss, the metal of the boss in the area around said point being thin so that the heating element cast in said boss is close to said point, said area being in communication with the vaporization chamber.

2. An electric steam iron as defined in claim 1, wherein the thin area of the boss is substantially planar and has a slope descending towards the vaporization chamber.

3. An electric steam iron as defined in claim 2, wherein the thin and substantially planar area has an enlarged portion situated in the area of the auxiliary injection point.

* * * * *